252-102 AU 157 EX
3/24/87 XR 4,652,403

United States Patent [19]
May et al.

[11] Patent Number: 4,652,403
[45] Date of Patent: Mar. 24, 1987

[54] DETERGENT COMPOSITIONS CONTAINING ALUMINOSILICATES AND AMINOPOLY(METHYLENEPHOSPHONATES)

[75] Inventors: Bronislav A. May, Overijse; Hubert H. Nijs, Leuven, both of Belgium

[73] Assignee: Monsanto Company, St. Louis, Mo.

[21] Appl. No.: 738,728

[22] Filed: May 29, 1985

[30] Foreign Application Priority Data

Jun. 6, 1984 [GB] United Kingdom ..... 8414407

[51] Int. Cl.[4] ..... C11D 3/12; C11D 3/36; C11D 3/39

[52] U.S. Cl. ..... 252/526; 252/102; 252/140; 252/155; 252/174.25; 252/545; 252/DIG. 11

[58] Field of Search ..... 252/140, 155, 174.16, 252/174.25, 179, 102, 526, 545

[56] References Cited

U.S. PATENT DOCUMENTS

| | | | |
|---|---|---|---|
| 4,148,603 | 4/1979 | Schwuger | 8/137 |
| 4,169,075 | 9/1979 | Kuhling | 252/558 |
| 4,179,391 | 12/1979 | Kaufmann | 252/99 |
| 4,269,725 | 5/1981 | Smith | 252/174.25 |

FOREIGN PATENT DOCUMENTS

| | | | |
|---|---|---|---|
| 0001853 | 5/1979 | European Pat. Off. | 252/174.25 |
| 1596756 | 8/1981 | United Kingdom . | |

*Primary Examiner*—Dennis L. Albrecht
*Attorney, Agent, or Firm*—R. Loyer

[57] ABSTRACT

Detergent compositions are disclosed which contain on a dry weight basis, from 1 to 40% of a water-insoluble aluminosilicate and from 0.5 to 5% of a aminopoly(methylenephosphonate) component which is a mixture of an ethylenediamine derivative of the formula

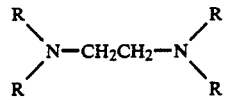

and a diethylenetriamine derivative of the formula

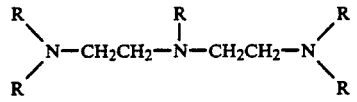

wherein, in each formula, R is selected from H, $—CH_2PO_3M_2$ and $—CH_3$ wherein M is selected from hydrogen and alkali metal, provided that at least 3 Rs are $—CH_2PO_3M_2$ and further provided that the weight ratio of ethylenediamine derivative to diethylenetriamine derivative is from 3:1 to 1:5, and the combined weight of the aluminosilicate material and the aminopoly(methylenephosphonate) component is at least 5% of the dry weight of the composition.

12 Claims, No Drawings

DETERGENT COMPOSITIONS CONTAINING ALUMINOSILICATES AND AMINOPOLY(METHYLENEPHOSPHONATES)

This invention relates to detergent compositions for washing fabrics and to combinations of components for use therein.

For many years, phosphates such as sodium tripolyphosphate haave been used as components of laundry detergent compositions because of their beneficial effect on the cleaning efficiency of the surfactant component. Recently, however, there have been moves to reduce the amounts of phosphates included in detergent compositions because of indications that soluble phosphates were reaching natural water systems in quantities which excessively promoted the growth of algae to the detriment of other aquatic life.

Much effort has been devoted to the search for alternative so-called 'builder' materials which could at least partially replace the phosphates while maintaining the performance of detergent compositions, and without adding significantly to costs, and which would be environmentally acceptable.

Aluminosilicate materials having ion-exchange capability have been proposed for this purpose, and the prior art also disclosed various aminopoly(methylenephosphonates) as components of detergent formulations.

We have now discovered that aluminosilicates in conjunction with mixtures of certain aminopoly(methylenephosphonates) can be used as efective detergent builders meeting the above criteria at surprisingly low levels of addition.

The detergent compositions of this invention contain a surfactant, other conventional additives, and are characterised in that they contain, on a dry weight basis, from about 1 to about 40% of a water-insoluble aluminosilicate and from about 0.5 to about 5% of an aminopoly(methylenephosphonate) component which is a mixture of an ethylenediamine derivative represented by the formula:

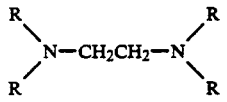

and a diethylenetriamine derivative represented by the formula:

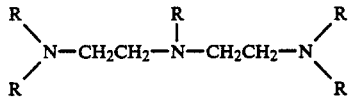

wherein, in each formula, R is selected from H, $—CH_2PO_3M_2$ and $—CH_3$ wherein M is selected from hydrogen and alkali metal, provided that at least 3 Rs are $—CH_2PO—3M_2$ and further provided that the weight ratio of ethylenediamine derivative to diethylenetriamine derivative is from 3:1 to 1:5, and the combined weight of the aluminosilicate material and the aminopoly(methylenephosphonate) component is at least 5% of the dry weight of the composition.

Preferred aluminosilicate materials are those of the zeolite-type, particularly those of the general formula:

$$Na_b(AlO_2)_b(SiO_2)_c dH_2O$$

wherein b and c are integers of at least 6, the molar ratio of b to c is in the range from 1.0 to 0.5 and d is a number such that the moisture content of the aluminosilicate is from about 10% to about 35% by weight. Preferred aluminosilicates of this type belong to the faujasite group and include faujasite itself and the synthetic zeolites A, X, and Y conventionally represented by the following formulae:

| | |
|---|---|
| $Na_{12}(AlO_2)_{12}(SiO_2)_{12}.27\ H_2O$ | Zeolite A |
| $Na_{86}(AlO_2)_{86}(SiO_2)_{106}.264\ H_2O$ | Zeolite X |
| $Na_6(AlO_2)_6(SiO_2)_{10}.15\ H_2O$ | Zeolite Y |

Preferred synthetic zeolites are prepared from metakoalin by heating with alkali alone (in the case of zeolites having a 1:1 $AlO_2$:$SiO_2$ ratio such as Zeolite A) or with mixtures of alkali and additional silica provided, for instance, in the form of sodium silicate or colloidal silica (in the case of zeolites having $AlO_2$:$SiO_2$ ratios of less than 1, e.g., Zeolite X).

The preferred aluminosilicates have an average particle size of less than about 4 micrometers, especially less than about 1 micrometer, and surface area greater than about 5 $m^2/g$, preferably greater than about 10 $m^2/g$.

In the compositions of the present invention, the aminopoly(methylenephosphonates) are preferably used in the form of their sodium salts. The commercially available sodium aminopoly(methylenephosphonates) are themselves usually mixtures, the major component of the ethylenediamine derivative being the compound in which the four R groups in the above formula are all $—CH_2PO_3Na_2$ or $—CH_2PO_3HNa$, but the compounds in which three or two R groups are $—CH_2PO_3Na_2$ or $—CH_2PO_3HNa$, the other(s) being hydrogen or $—CH_3$ are also present. Preferably at least 80% of the R groups in the mixture are $—CH_2PO_3Na_2$ or $—CH_2PO_3HNa$ groups. Similarly, in the diethylenetriamine derivatives, the penta(methylenephosphonate) usually accounts for from 60 to 80% of the total weight of the derivative, the remainder being mostly the tri(methylenephosphonate) with a small amount of the tetra(methylenephosphonate). Preferably at least 65% of the R groups in the mixture are $—CH_2PO_3Na_2$ or $CH_2PO_3HNa$ groups.

The compositions of the invention contain at least 1% by weight of the aluminosilicate as anhydrous material. Washing performance improves as the amount of aluminosilicate is increased, and generally it is preferred to include at least 4% of aluminosilicate. A preferred upper limit is about 15%, and often the optimum quantity of aluminosilicate is in the range 5 to 10%.

Preferably a composition of the invention contains at least 0.7% of the aminopoly(methylenephosphonate) component, and although, as indicated above, up to 5% may be present, it is generally not cost-effective to include more than about 2%.

Preferred ranges for the ratios of ethylenediamine derivative to the diethylenetriamine derivative in the aminopoly(methylenephosphonate) component are from 2:1 to 1:4, more especially from 1:1 to 1:3. Mixtures in which the ratio is from 1:1.5 to 1:2.5, for example approximately 1:2, are particularly effective.

The surfactant component of the compositions of the present invention usually comprises one or more anionic surfactants, or a mixture of one or more anionic surfactants with one or more nonionic surfactants. Examples of suitable anionic surfactants include soaps such as the salts of fatty acids containing about 9 to 20 carbon atoms, e.g., salts of fatty acids derived from coconut oil and tallow; alkyl benzene sulphonates, particularly linear alkyl benzene sulphonates; alkyl sulphates and sulphonates; monoglyceride sulphates, and acid condensates of fatty acid chlorides with hydroxy alkyl sulphonates.

Examples of suitable nonionic surfactants include condensates of alkylene oxides (e.g., ethylene oxide), with mono- or poly-hydroxy alcohols, alkyl phenols, fatty acid amides or with fatty amines; sugar derivatives such as sucrose monopalmitate; or fatty acid amides.

In certain instances, the surfactant may include compounds having at least one tertiary amine oxide group, for example dimethyl dodecylamine oxide.

Preferably the surfactant component contains ($C_{10-16}$ alkyl)benzene sulphonate, in an amount exceeding that of any other surfactant, and particularly good detergency performance has been obtained with surfactant components which are blends containing 40–60% by weight of one or more ($C_{10-16}$ alkyl)benzene sulphonates, 15–30% of condensates of fatty alcohols with 10–18 ethylene oxide units, and 15–30% of soaps.

It will be understood that many more examples of surfactants are known to those skilled in the art, and the compositions of the invention may contain other compounds having surfactant activity, for example switterionic and amphoteric surfactants.

The quantity of surfactant in a composition of the invention will depend on its particular ingredients, but normally the composition will contain at least 5%, for example, from 5 to 50% by weight. In most instances, the optimum amount is within the range 10 to 30% by weight.

The compositions of the invention preferably include a peroxygen bleaching compound, i.e., a compound capable of yielding hydrogen peroxide in aqueous solution. Such compounds are well known in the art, and include organic peroxide bleaching compounds, for example alpha-omega $C_{2-12}$ alkanediperoxycarboxylic acids and their salts, aromatic diperoxycarboxylic acids and their salts, aromatic monoperoxydioic acids and their salts, for example monoperoxyphthalic acid and its salts, and inorganic persalt bleaching compounds, such as the alkali metal perborates, percarbonates and perphosphates. Mixtures of two or more such bleaching compounds can also be used, if desired.

Preferred peroxygen bleaching compounds include sodium perborate commercially available in the form of mono- and tetrahydrate, sodium carbonate peroxyhydrate, sodium pyrophosphate peroxyhydrate, urea peroxyhydrate, and sodium peroxide. Particularly preferred are sodium perborate tetrahydrate and sodium perborate monohydrate.

The level at which the peroxygen bleaching compound is present in a composition of the invention depends on the particular compound or compounds selected, but is usually within the range 2 to 50% by weight of the composition. For the particularly preferred sodium perborates, the optimum amount is normally within the range 15 to 40% for the tetrahyrate, with a correspondingly lower range for the monohydrate.

From the functional point of view, it is usually advantageous to include additional builders, for example, phosphates, nitrolotriacetates or polycarboxylates, in the compositions of the present invention, but considerably lower amounts are required than would be required for equivalent washing performance in the absence of the combination of aluminosilicate and aminopoly(methylenephosphonate) components which characterises the present invention. Sodium tripolyphosphate or mixtures of sodium tripolyphosphate with polyphosphates or orthophosphates, at a level of, for example, from 5 to 20% by weight of the composition, may be used. Alternatively, or additionally, a composition of the invention may contain, for example, from 2 to 10% by weight of sodium nitrilotriacetate.

The invention is illustrated by the following Examples.

EXAMPLE 1

Examples of compositions of the present invention were evaluated using various standard commercial soil/stain swatches of the same size sewn on to 1 m×1 m cotton cloths and washed with various other items, giving a total load of 2 kg for washes at 40° C. and a total load of 4 kg for washes at 60° C. The washing machine was a Miele-Model 753 taking 20 l of water for the wash. An IEC (International Electrotechnical Commission Geneva) type test detergent was used, but with some variations in proportions.

The IEC Test Detergent with Perborate, Type 1, has the following composition:

| | | |
|---|---|---|
| Linear sodium alkyl benzene sulphonate (mean length of alkane chain: $C_{11.5}$) | 6.4% | |
| Ethoxylated tallow alcohol (14 EO) | 2.3% | |
| Sodium soap (chain length $C_{12-16}$: 13–26%; $C_{18-22}$:74–87%) | 2.8% | |
| Sodium triphosphate | 35.0% | |
| Sodium silicate ($SiO_2$:$Na_2O$ = 3.3:1) | 6.0% | |
| Magnesium silicate | 1.5% | |
| Carboxymethylcellulose | 1.0% | |
| Sodium ethylenediaminetetraacetate | 0.2% | |
| Optical whitener for cotton (stilbene type) | 0.2% | |
| Sodium sulphate (as accompanying substance or added) | 16.8% | |
| Water | 7.8% | |
| Spray dried powder (detergent base) | 80.0% | 80.0% |
| Sodium perborate tetrahydrate | | 20.0% |
| IEC Test Detergent with Perborate, Type I | | 100.0% |

In the present evaluations, the detergent contained sodium tripolyphosphate 18%, other builders, and sodium perborate tetrahydrate 30%. Other components of the IEC formulation were present, but not magnesium silicate nor EDTA. Balance to 100% was achieved with sodium sulphate.

The builder component characteristic of the present invention was made up of various amounts of zeolite, Dequest ®2046 phosphonate, a neutral solution containing approximately 35% by weight of the sodium salts of ethylenediamine poly(methylenephosphonic acids), the major component being the tetrasodium salt of ethylenediamine tetra(methylenephosphonic acid) and Dequest ®2066 phosphonate, a neutral solution containing approximately 35% by weight of the sodium salts of diethylenetriamine poly(methylenephosphonic acids), the major component being the pentasodium salt of diethylenetriaminepenta(methylenephosphonic acid), were added.

The dosage of the complete detergent composition was 7.5 g/l. The water had a "German hardness" of 21°, equivalent to 384 ml/l calcium carbonate, with a Ca:Mg mole ratio of 3:1.

After the washing cycle was completed, the cloths carrying the swatches were dried and lightly ironed. Washing efficiency was assessed by brightness measurements on the swatches defined as the reflectance of stimulus Z ("blue" light) relative to a standard white reference with an IEC three stimulus colorimeter. The reflectance of both sides of the swatches was measured and the reflectance values averaged.

In washes at 40° C. and at 60° C., a composition (A) containing 5% of zeolite (3.25% dry weight aluminosilicate), 1.67% of Dequest®2066 phosphonate (0.58% sodium salt on an anhydrous basis) and 0.83% of Dequest®2046 phosphonate (0.29% sodium salt on an anhydrous basis) showed better detergency performance on WFK (Waschereiforschung Krefeld) soiled cotton, polyester-cotton and WFK cocoa-oil swatches than a composition (b) containing 5% of zeolite, 0.83% of Dequest 2066 phosphonate and 1.67% of Dequest 2046 phosphonate. (Percentages are parts by weight per 100 parts by weight of spray dried base formulation.) In the 40° C. wash, compositions (a) and (B) generally gave superior performance to a formulation (C) containing 15% of zeolite and no phosphonates, and to a formulation (D) containing 1.25% of Dequest 2066 phosphonate and 2.5% of Dequest 2046 phosphonate but no zeolite. In the 60° C. wash, composition (A) was significantly better than the others.

In a 60° C. wash, composition (A) was markedly superior to the other compositions in removing stains of blood, cocoa, coffee and tea.

Actual average reflectance values obtained were as follows:

| | Detergency | | |
|---|---|---|---|
| | WFK COTTON | WFK POLY-ESTER/ COTTON | WFK COCOA OIL |
| Composition A | | | |
| 40° C. wash | 65.4 | 48.8 | 84.2 |
| 60° C. wash | 90.2 | 63.1 | >100 |
| Composition B | | | |
| 40° C. wash | 64.8 | 48.2 | 60.4 |
| 60° C. wash | 84.8 | 58.8 | 81.4 |
| Composition C | | | |
| 40° C. wash | 56.4 | 45.8 | 55.2 |
| 60° C. wash | 83.2 | 57.8 | 77.2 |
| Composition D | | | |
| 40° C. wash | 56.6 | 44.8 | 53.7 |
| 60° C. wash | 84.8 | 58.8 | 82.2 |

| | BLEACHING 60° C. WASH | | | |
|---|---|---|---|---|
| | Blood | Cocoa | Coffee | Tea |
| Composition A | 71.7 | 95 | 114.1 | 100.5 |
| Composition B | 60.5 | 91.1 | 106.5 | 93.2 |
| Composition C | 62 | 87.5 | 98.9 | 90.2 |
| Composition D | 67 | 91 | 101.4 | 93.2 |

EXAMPLE 2

Compositions having the following ingredients in parts by weight were evaluated for detergency effectiveness by the method described in Example 1 in a machine wash at 60° C. A detergent base similar to that of the IEC Test Degergent formulation shown above, except that the sodium triphosphate was omitted, was used. Composition No. 4 is an example of a composition of the invention. Compositions 1, 2, and 3 are comparative.

| Composition No. | 1 | 2 | 3 | 4 |
|---|---|---|---|---|
| IEC powder base | 72 | 72 | 72 | 72 |
| $NaBO_3 4H_2O$ | 25 | 25 | 25 | 25 |
| sodium nitrilotriacetate monohydrate | 4.2 | 4.2 | 4.2 | 4.2 |
| Zeolite | 40 | 32.5 | 32.5 | 32.5 |
| Dequest 2046 phosphonate | 0 | 2.8[a] | 0 | 0.9[b] |
| Dequest 2066 phosphonate | 0 | 0 | 2.8[a] | 1.9[c] |

[a]Equivalent to 1 part dry weight
[b]Equivalent to 0.32 part dry weight
[c]Equivalent to 0.66.

Average reflectance values measured were as follows:

| Composition No. | 1 | 2 | 3 | 4 |
|---|---|---|---|---|
| WFK Polyester | 59.2 | 55 | 55 | 59.1 |
| WFK Cotton | 88.0 | 87 | 87.1 | 99.5 |

The superiority of Composition No. 4 is clear from the results, which in fact illustrate synergism between the two phosphonates.

What is claimed is:

1. A detergent composition comprising a surfactant, other conventional additives, and on a dry weight basis, from 4 to 15% of a water-insoluble aluminosilicate and from 0.5 to 2.5% of an aminopoly(methylenephosphonate) component which is a mixture of an ethylenediamine derivative of the formula

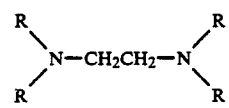

and a diethylenetriamine derivative of the formula

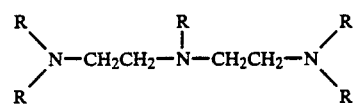

wherein, in each formula, R is selected from H, $—CH_2PO_3M_2$ and $—CH_3$ wherein M is selected from hydrogen and alkali metal, provided that at least 80% of the Rs are $—CH_2PO_3M_2$ and further provided that the weight ratio of ethylenediamine derivative to diethylenetriamine derivative is about 1.2, and the combined weight of the aluminosilicate material and the aminopoly(methylenephosphonate) component is at least 5% of the dry weight of the composition.

2. A composition of claim 1 in which the water-insoluble aluminosilicate is a zeolite having an average particle size less than 1 micrometer.

3. A composition of claim 1 comprising from 0.75% to 2% of the aminopoly(methylenephosphonate) component, but component being a mixture of an ethylenediamine derivative in which at least 3, or an average of at least 3, of the R groups represent $—CH_2PO_3Na_2$ or $—CH_2PO_3HNa$.

4. A composition of claim 1 which contains sodium tripolyphosphate or a mixture of sodium tripolyphosphate with pyrophosphates or orthophosphates, said sodium tripolyphosphate or mixture being present in an amount of from 5 to 20% by weight of the composition.

5. A composition of claim 1 further including from 2 to 10% by weight of sodium nitrilotriacetate.

6. A composition of claim 1 further including a peroxygen bleaching compound in an amount of from 2 to 50% by weight of the composition.

7. A composition of claim 1 wherein the water-insoluble aluminosilicate is in the range of from 5% to 10%.

8. A composition of claim 1 wherein at least 80% of the R groups are $—CH_2PO_3Na_2$ or $—CH_2PO_3HNa$ groups.

9. A composition of claim 1 wherein the water-insoluble aluminosilicate is a member of the faujasite group.

10. A composition of claim 1 wherein the water-insoluble aluminosilicate is a synthetic zeolite.

11. A composition of claim 1 wherein the water-insoluble aluminosilicate has an average particle size less than 1 micrometer and a surface area greater than 5 $m^2/g$.

12. A composition of claim 1 wherein the aminopoly(methylenephosphonate) is in the form of its sodium salt.

* * * * *

UNITED STATES PATENT AND TRADEMARK OFFICE

CERTIFICATE OF CORRECTION

PATENT NO. : 4,652,403

DATED : March 24, 1987

INVENTOR(S) : Bronislav A. May et al

It is certified that error appears in the above—identified patent and that said Letters Patent is hereby corrected as shown below:

Column 1, line 10, delete "haave" and substitute therefor --have--.

Column 1, line 31, delete "efective" and substitute therefor --effective--.

Column 4, line 65, delete extra spaces after "of".

Column 5, line 1, delete "ml/l" and substitute therefor --mg/l--.

Column 6, line 65, delete "but" and substitute therefor --that--.

Signed and Sealed this

Fourteenth Day of July, 1987

*Attest:*

*Attesting Officer*

DONALD J. QUIGG

*Commissioner of Patents and Trademarks*